US006994126B2

(12) United States Patent
Marino

(10) Patent No.: US 6,994,126 B2
(45) **Date of Patent: *Feb. 7, 2006**

(54) HIGH-POWER SQUIRT GUN

(76) Inventor: Frank Marino, 394 Meredith Neck Rd., Meredith, NH (US) 03253

( * ) Notice: Subject to any disclaimer, the term of this patent is extended or adjusted under 35 U.S.C. 154(b) by 244 days.

This patent is subject to a terminal disclaimer.

(21) Appl. No.: 10/658,503

(22) Filed: Sep. 10, 2003

(65) Prior Publication Data

US 2004/0045981 A1 Mar. 11, 2004

Related U.S. Application Data

(63) Continuation of application No. 10/194,776, filed on Jul. 15, 2002, now Pat. No. 6,651,702.

(60) Provisional application No. 60/305,680, filed on Jul. 16, 2001, provisional application No. 60/351,404, filed on Jan. 28, 2002.

(51) Int. Cl.
*B65B 1/04* (2006.01)

(52) U.S. Cl. ..... 141/26; 141/21; 141/25; 141/114; 222/79; 222/380; 222/494

(58) Field of Classification Search ..... 141/18, 141/21, 25–27, 67, 114, 383, 384, 392; 222/38, 222/78, 79, 324, 340, 372, 380, 401, 402, 222/384–387, 494, 495
See application file for complete search history.

(56) References Cited

U.S. PATENT DOCUMENTS 4,135,559 A 1/1979 Barnby
4,257,460 A 3/1981 Paranay
4,735,239 A 4/1988 Salmon
4,854,480 A 8/1989 Shindo
5,284,300 A 2/1994 Gries et al.
5,662,244 A 9/1997 Liu et al.
5,758,800 A 6/1998 D'Andrade
5,878,914 A 3/1999 Johnson
5,906,295 A 5/1999 D'Andrade
5,984,140 A 11/1999 Amron
6,012,609 A 1/2000 D'Andrade
6,167,925 B1 1/2001 D'Andrade
6,193,107 B1 2/2001 D'Andrade
6,651,702 B2 * 11/2003 Marino ..... 141/26

* cited by examiner

*Primary Examiner*—Timothy L. Maust
(74) *Attorney, Agent, or Firm*—Frank Marino

(57) ABSTRACT

A squirt gun includes a hollow housing in the form of a gun with a liquid dispensing assembly within the housing. The liquid dispensing assembly includes a rigid pressure vessel having either a gas-filled compressible bladder or a spring-loaded piston disposed within. The vessel is connected to a flexible tube with a nozzle at one end, and the gun is adapted to receive and expel water to and from the vessel through the nozzle. A pivotable trigger cooperates with the flexible tube to either enable both the receiving and expelling, or to deny the expelling of the water. To fill the gun, water is forced into the vessel under pressure, which compresses the air bladder or the piston to retain that pressure within the water-filled vessel. To expel the retained water, the trigger is moved to an "open" position, which allows the water to be forced from the pressurized water-filled vessel, through the nozzle, and from the gun as the air bladder or the piston expands. An adapter is provided which is threadable on a faucet, for filling the squirt gun with water at the pressure of the water supply.

19 Claims, 7 Drawing Sheets

HIGH-POWER SQUIRT GUN

RELATED APPLICATION

This application is a continuation of U.S. application Ser. No. 10/194,776, filed Jul. 15, 2002 now U.S. Pat. No. 6,651,702, and to those U.S. Provisional Applications to which said application was related; Ser. No. 60/305,680 filed on Jul. 16, 2001 and Ser. No. 60/351,404 filed on Jan. 28, 2002, whose specifications are incorporated herein by reference.

FIELD OF THE INVENTION

This invention relates generally to squirt guns, and more particularly to squirt guns that are capable of receiving liquid under pressure and thence dispensing the liquid at a high velocity to a great distance.

The present invention is an improvement adaptable to squirt guns such as the types of guns generally disclosed in U.S. Pat. Nos. 4,135,559, 4,257,460, 4,735,239, 4,854,480, 5,758,800, 5,906,295, 6,012,609, 6,193,107, whose specifications are incorporated herein by reference, except that the "expandable bladder" systems disclosed in those guns is to be replaced by the similar and more effective "compressible air-filled bladder" or "spring-loaded piston" systems of the present invention. The structure of similar guns manufactured by Yes Entertainment Systems and publicly sold under model numbers 2000, 2500, 3000, 4500, and others, but which are not the subject of any patents or publications known to the inventor, are also incorporated herein by reference.

BACKGROUND OF THE INVENTION

High-pressure squirt guns have long been known in the prior art. Such squirt guns usually include a hollow housing having a squirt hole from which water is expelled. The housing may be fashioned in the shape of a rifle or pistol which includes within an expandable rubber bladder connected to filling and release means. The filling means comprises a one-way flow valve that is connectable to the household water supply and allows water to flow only from the supply into the bladder when the release means is in its normal position. It is common to dispose the filling means at the squirt hole so that water is received into and expelled from the gun through the same hole. The release means includes a trigger and is adapted to allow water to leave the bladder through the squirt hole only when the trigger is activated. The bladder is intended to accept the water through the filling means at standard household water line pressure, to expand according to the pressure of the supply and the resiliency of the bladder, to hold that water indefinitely under that pressure, and to release the water when the trigger is activated.

Problems common to all such expandable bladder type squirt guns are several-fold. Firstly, the bladders must be designed to safely hold water at great pressure, which requires that the rubber walls be very thick and of high quality. Such bladders are therefore inherently expensive. Secondly, regardless of the economy of the bladder itself, the deterioration of the rubber over time may render the bladders less reliable and such bladders are therefore inherently unsafe without some sort of pressure relief valve. Such relief valves are found in the cited prior art, but are additionally expensive. Thirdly, such relief valves limit the maximum pressure at which the gun may accept water from the source, regardless of the actual pressure of the source. As a result, such prior art guns are unable to expel water to a distance that would otherwise be possible. Fourthly, the relaxed bladder has a volume in its normal and unexpanded state, such as after the bladder is filled and emptied, that undesirably retains a substantial amount of water even after the pressure has been fully reduced. So such guns are incapable of expelling a large portion of the water that they can hold. It is common, for instance, for a "one-gallon" gun to hold one gallon of water when filled at normal supply pressure, but to only expel two quarts and to retain two quarts in its bladder when the pressure has been depleted. Fifthly, it is difficult to control the pressure reduction within the bladder and therefore the velocity at which the water is expelled. Several of the cited prior art guns have means which attempt to retain consistent velocity, but the nature of rubber bladders render such attempts unreliable at best. Generally speaking, these guns initially expel water at high velocity, but the velocity drops off rapidly and the squirt distance diminishes rapidly as the water is expelled.

Other prior art squirt guns utilize compressed gas to assist in forcing greater quantities of liquid out from the squirt gun to greater distances. One method of injecting compressed gas into the hollow housing of the gun is in the use of a removable cartridge of compressed gas. Other versions of compressed-air type squirt guns utilize manually actuated hand pumps that will introduce air into the housing and compress the air by pumping action. While both such squirt guns expel water to a long distance, the pressure maintained in the housing must be replenished by pumping or by the use of an additional cartridge of compressed gas. Furthermore, the use of compressed gas requires at least some space within the hollow housing into which the gas may be compressed so as to force the water out of the nozzle. This limits the amount of liquid that may be inserted in the squirt gun.

Problems common to all pump-type squirt guns reside in their use of complicated pump mechanisms with many parts. Not only are such mechanisms expensive, but also, they are also prone to breakage during use.

It is therefore a principle object of the present invention to provide an improved trigger-actuated squirt gun capable of propelling liquid a long distance.

Another object of the present invention is to provide an improved squirt gun that does not require the use of externally supplied compressed gas or pump mechanisms.

A further object of the present invention is to provide a long-range trigger-actuated squirt gun with very few moving parts.

Still another object is to provide a squirt gun that is simple in operation, economical to manufacture, safe, durable in use and refined in appearance.

Still another object is to provide a squirt gun that is capable of receiving water from a water supply at any anticipated pressure and to hold and expel water at that pressure so that the squirt distance can be maximized.

These and other objects will be apparent to those skilled in the related arts upon review of the disclosure herein provided for the present invention.

SUMMARY OF THE INVENTION

The long-range trigger-actuated squirt gun of the present invention includes a hollow housing in the form of a gun, consistent with squirt gun housings of the prior art. A liquid dispensing assembly within the housing includes a rigid pressure vessel in which is disposed either a sealed compressible air-filled bladder according to the preferred embodiment or, alternately, a spring-loaded piston according to a second embodiment.

The bladder of the preferred embodiment is initially filled with air or another gas at or above atmospheric pressure, then sealed to retain that air, and is adapted so that at such a pressure it has a normal volume that substantially fills the pressure vessel. The bladder thereby forms a liner within the interior chamber of the vessel when the vessel is empty of water.

The pressure vessel is connected through a tube to a nozzle at one end, and is adapted to receive and dispense water through the nozzle, tube, and a one-way valve, all in communication therewith. The one-way valve allows water to flow only into the pressure vessel when the nozzle is applied to the pressurized water supply, but prevents water from flowing out of the nozzle when the nozzle is removed from the water supply.

It is anticipated that many of the nozzle arrangements for filling and enabling/disabling water flow could be readily adapted from the prior art or future designs to the present pressure vessel system without departing from the scope of the invention.

When the gun is connected to a pressurized water supply, water is received into the chamber between the inner wall of the pressure vessel and the outer wall of the air-filled bladder. In the herein-disclosed embodiment, an adaptor facilitates quick connection of the gun to and removal of the gun from a faucet. The pressure of the incoming water from the water supply causes the air-filled bladder to be compressed until the pressure within the bladder equalizes to the pressure of the supply. The volume of the bladder is greatly reduced as a result of this pressure and this change in volume equates to the volume of water acceptable by the vessel, and therefore by the gun. The pressure vessel is constructed such that it can safely hold water at the highest pressure anticipated from a water supply. This provides that no pressure relief valve is required, although a pressure relief valve such as, but not limited to, those found in the prior art can be included without departing from the scope of the invention.

A pivotable trigger is mounted in communication with the tube and with one end accessible to the user for actuation. In the here-disclosed embodiment, the one-way valve is incorporated into the trigger, but the trigger and one-way valve could be distinct, so long as they are adapted to cooperate in an equivalent manner and achieve the same result. The trigger is adapted to communicate with the tube so that it denies water flow out of the gun in its normal "closed" position, but actuating the trigger into an "open" position allows liquid to flow through the tube and to be propelled out of the nozzle. This is common to the prior art, and many of the arrangements from the prior art are adaptable to the invention without departing form the scope of the invention.

As water is expelled from the pressure vessel, the air-filled bladder returns to its normal volume and refills the inner chamber of the pressure vessel so that substantially all the water taken into the gun is expelled. It is found that the flow of water from guns of the present invention is stronger and more consistent through the entire time of squirting with this system than with any guns found in the prior art.

As stated, an adaptor is provided which is threadable onto a faucet, for filling the gun. A small aperture in the adapter corresponds with the nozzle of the squirt gun to allow filling.

As mentioned, a second embodiment is anticipated in which the rigid pressure vessel includes a spring-loaded piston in place of the sealed compressible air-filled bladder of the preferred embodiment. In this second embodiment as disclosed, the spring is biased towards its extended state, which biases the piston towards the nozzle end of the pressure vessel. The piston is longitudinally slidable within the vessel's interior chamber and the circular periphery of the piston seals against the cylindrical inside wall of the vessel in a slidable relationship to separate the vessel's interior chamber into a water-holding portion and an energy-holding portion. Such slidable sealing may be accomplished by various conventional means including those commonly used in manually operated piston-type pumps.

Initially, the water-holding portion is empty of water and minimal in volume as the piston is biased by the extended spring towards the nozzle end of the vessel. Also initially, the energy holding portion is in a low energy state and maximal in volume as the spring is fully extended to occupy most of the chamber's interior.

When the gun is connected to a pressurized water supply using the same technique of the preferred embodiment, water is received into the water-holding portion of the chamber on the side of the piston opposite of the spring. The pressure of the incoming water from the water supply causes the spring to be compressed and the piston to move longitudinally away from the vessel's nozzle end and causes the chamber's water-holding portion to expand simultaneously. This expansion of the water-holding portion, concurrent with the compression of the energy-holding portion, continues until the force against the piston from the energy-holding portion equalizes with the pressure of the supply. The volume of the energy-holding portion is greatly reduced as a result of this pressure and this change in volume equates to the volume of water acceptable by the water-holding portion, and therefore by the gun. The pressure vessel of this embodiment is similarly constructed such that it can safely hold water at the highest pressure anticipated from a water supply. This similarly provides that no pressure relief valve is required, although such is easily and inexpensively accomplished by a simplified valve means such as that disclosed herein. Alternately, those such as may be found in the prior art can be included without departing from the scope of the invention.

A similar trigger arrangement is adapted to allow water flow into but deny water flow out of the gun in its normal "closed" position. Actuating the trigger into an "open" position similarly allows water to flow through the tube and to be propelled out of the nozzle.

As water is expelled from the pressure vessel, the piston is forced by the expanding spring towards the nozzle end of the vessel the chamber's water-holding portion returns to its normally depleted state so that substantially all the water taken into the gun is expelled. The spring is selected to provide a substantially linear force against the piston over the full range of its compression and expansion within the chamber so that the flow of water from guns of the present invention is stronger and more consistent through the entire time of squirting with this system than with any guns found in the prior art.

DESCRIPTION OF THE PREFERRED EMBODIMENT OF THE INVENTION

Figure 1:
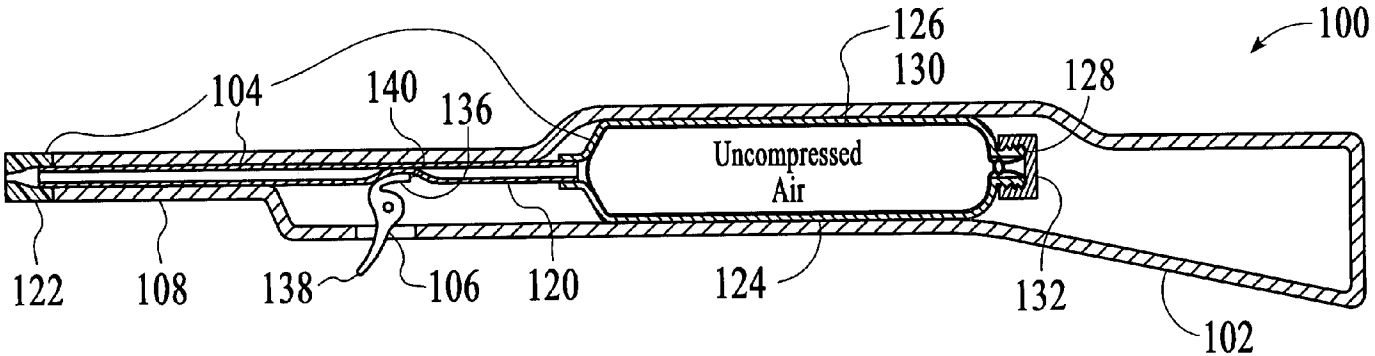
FIG. 1 is a side elevational view of a squirt gun according the present invention, having the housing in the form of a rifle and with the vessel empty of water.

Referring first to FIGS. 1 through 6, a squirt gun according to the preferred of many possible embodiments of the invention is shown. Squirt gun 100 includes a hollow housing 102 in the shape of a rifle, a water-dispensing assembly 104, and a trigger 106.

Figure 5:
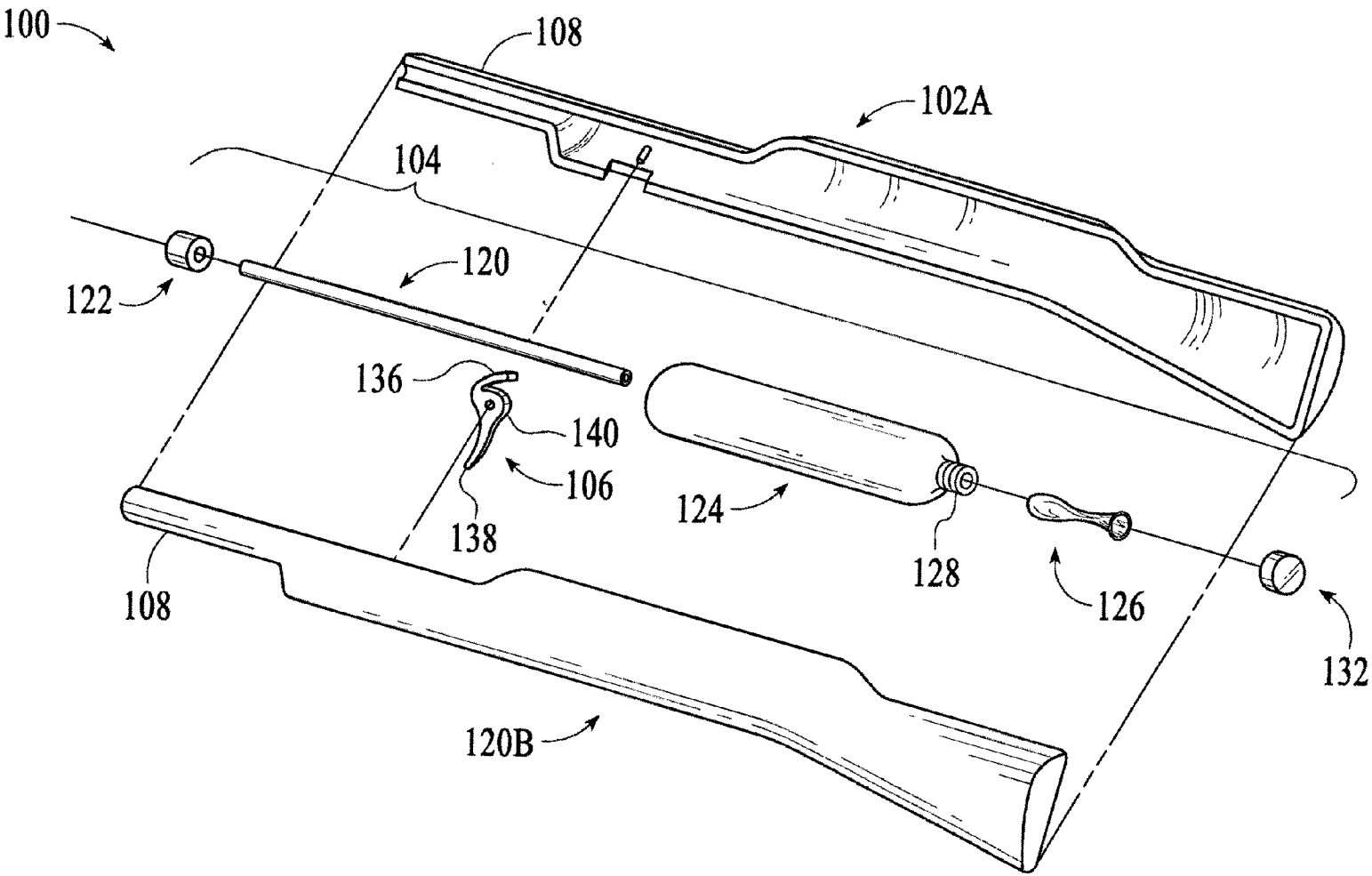
FIG. 5 is an exploded perspective view of the gun of FIG. 1.

Housing 102 has a barrel portion 108. As best seen in FIG. 5, the housing is comprised of two halves, 102A and 102B, which are glued or otherwise fastened together by ordinary means common among the cited prior art (screws, integrated snaps, ultrasonic welding, etc). Water dispensing assembly 104 is mounted within housing 102, and includes a flexible tube portion 120 having a nozzle 122 at one end, and a rigid vessel 124 connected to the other end. It is anticipated that the nozzle could readily be incorporated integrally into the housing to thereby eliminate that additional component, if so desired.

In the present embodiment, vessel 124 is a blow-molded polyethylene terephthalate bottle having a wall thickness sufficient to safely contain water at pressures substantially above the maximum anticipated from a municipal water supply. However, it is anticipated that the vessel could be incorporated into the housing 102, provided that the housing walls were sufficiently strong and the housing halves are firmly and fully sealed together.

Within vessel 124 is disposed an air-filled bladder 126 which is comprised of a resilient material so that the bladder is compressible in width and length when vessel 124 is filled with water at pressure that is positive relative to that in the bladder. In the preferred embodiment, the bladder is an ordinary heavy-walled balloon, however, it is found that any similarly flexible air-holding device, such as a simple plastic bag filled with air or a rubber bladder similar to those used in footballs and basketballs, provides similar results.

Vessel 124 has an opening 128 at the end opposite the flexible tube 120. This opening facilitates insertion of bladder 126 into vessel 124 in an unfilled state and inflation of bladder 124 through opening 128 until the bladder occupies the entirety of the vessel's interior chamber 130. Cap 132 closes opening 128 while simultaneously trapping bladder 126 so that the bladder always compresses towards and remains connected to that end of the vessel.

Figure 2:
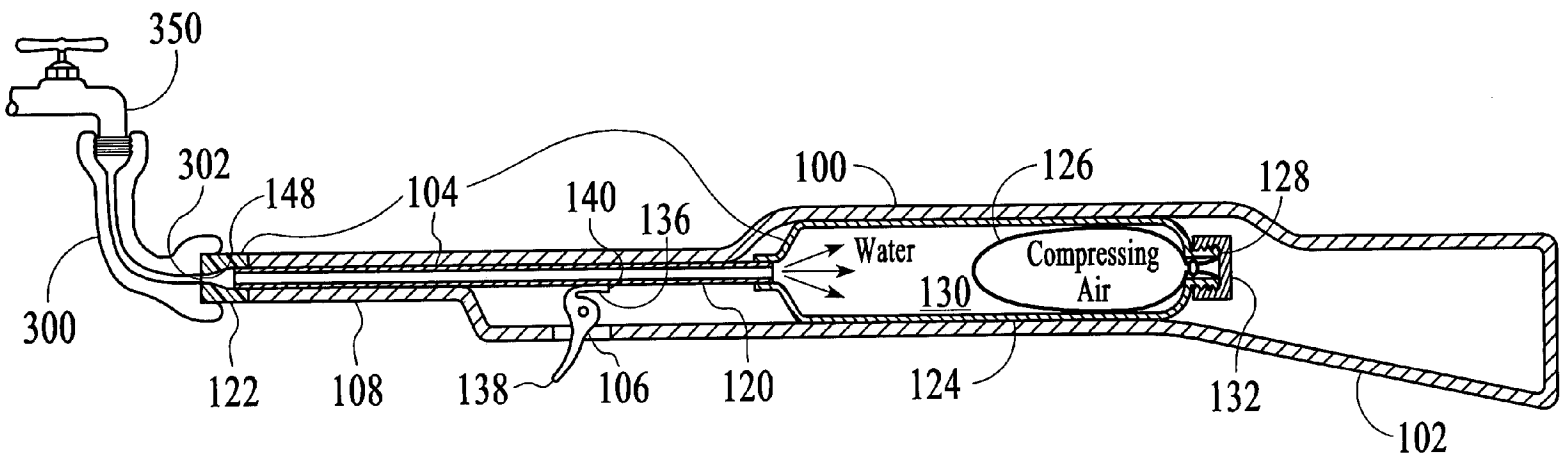
FIG. 2 is a side elevational view of the squirt gun of FIG. 1 with the nozzle connected to a water supply faucet and with water filling the vessel.
Figure 3:
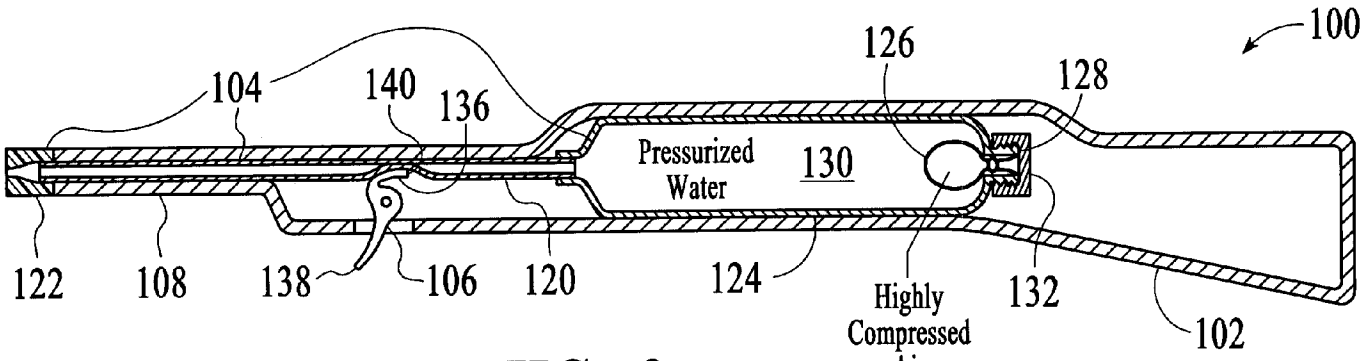
FIG. 3 is a side elevational view of the squirt gun of FIG. 1 with the vessel filled with water and the air-filled bladder in its compressed and pressurized state.
Figure 4:
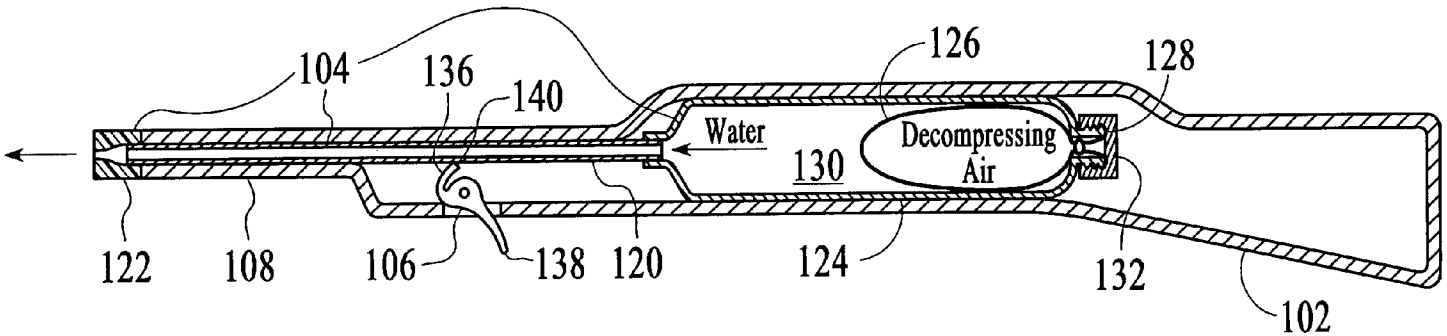
FIG. 4 is a side elevational view of the squirt gun of FIG. 1 with the trigger actuated to the "open" position and the vessel expelling water.

Trigger 106 is pivotally mounted to housing 102 with one end 138 projecting from the housing so as to be freely actuatable by the user. The trigger has two functional positions. The first and normal position being a "closed" position into which the trigger 106 is biased by a common torsion spring (not shown) or other means common among the prior art. In the "closed" position, end 138 is positioned forwardly as shown in FIGS. 1, 2 and 3. The second trigger position is the "open" position with end 138 forced rearwardly, against its normal bias, as shown in FIG. 4. The other end 140 of trigger 106 projects upwardly into housing 102 where it squeezes flexible tube 120 so that water cannot escape from vessel 124 when trigger 106 is in its normal "closed" position.

Trigger end 140 is adapted to cooperate with flexible tube 120 to function as a one-way valve, which prevents the flow of water through flexible tube 120 in either direction, except when the pressure at the nozzle end of the tube 120 is positive relative to that with the vessel 124, or when trigger 106 is forced by the user into the "open" position. This "one-way" function is realized because that positive pressure from the nozzle-end acts against the resiliency of a flexible arm 136, at end 140 of trigger 106, to force the arm 136 downwardly and allow water to flow through the tube 120. Naturally, the imbalance of pressures assures that such flow can only be directed into the vessel. Absent externally applied force from the user against trigger 106 to force it into the "open" position, the one way valve would prevent water from ever flowing in the other direction through tube 120, that being from vessel 124 and to nozzle 122. This trigger arrangement is actually just a schematic representation of similar triggers commonly used in the prior art, and other equivalently functioning valve and trigger means found elsewhere among the prior at could be readily substituted for this arrangement without departing from the scope of the invention.

In order to fill squirt gun 100 with water as shown in FIG. 2, an internally threaded adaptor 300 is first threaded onto a conventional exteriorly threaded faucet 350. Then the gun 100 is forced against adaptor 300 so that a small aperture 302 of the adaptor communicates with a mating aperture 148 of nozzle 122. Apertures 202 and 148 form a tight seal by the matching contours or their mating surfaces and the force applied to hold the gun 100 against the adaptor 300. The pressure of the water flowing from faucet 350 forces trigger arm 136 to flex downwardly and to allow water to flow through nozzle 122 and tube 120 and into vessel 124. This filling arrangement is actually meant to be similar to those commonly used in the prior art.

The pressure of the incoming water compresses bladder 126 within vessel 124 and fills interior chamber 130 with water as the volume of bladder 126 is reduced and until the pressure within the bladder is equal to the supply pressure and a pressurized equilibrium state is reached.

Once vessel 124 is so filled, nozzle 122 is separated from adaptor 200, causing the balance of pressure across trigger 106 to reverse from its filling condition, so that the pressure within vessel 124 is now positive relative to the atmospheric pressure at nozzle 122. As a result, the resiliency of trigger arm 136 causes it to return to its natural upwardly disposed position, thereby closing tube 120 so that the pressurized water within vessel 124 cannot escape.

To squirt water from filled gun 100, trigger 106 is actuated by the user into the "open" position, as shown in FIG. 4. The water within vessel 124, being maintained at high pressure by the compression of bladder 126, escapes at high velocity from vessel 124, through flexible tube 120 and nozzle 122, and squirts from the gun in a stream that is found to reach distances over thirty feet for guns filled at forty-five PSI of pressure.

It is found that the velocity of the water stream squirting from the gun 100, as well as the stream's distance, remain relatively constant, compared to guns of the prior art, throughout the full use of gun 100, from full to empty. It is believed that this quality results from the increase in surface area of bladder 126 as it expands, which balances with the decrease in pressure being realized.

It can be seen that the squirt gun of this invention will cause a stream of liquid to be propelled at a high velocity to a great distance, while utilizing very few moving pieces and requiring no separate pressure supply. The squirt gun will always be capable of dispensing liquid by actuating the trigger without requiring the use of a pump to pump up pressure as in some prior art squirt guns, and without requiring the use of a compressed air cartridge, electric pump, or expandable rubber water-holding bladder. It can therefore be seen the instant invention accomplishes at least all of the above-stated objectives.

Figure 6:
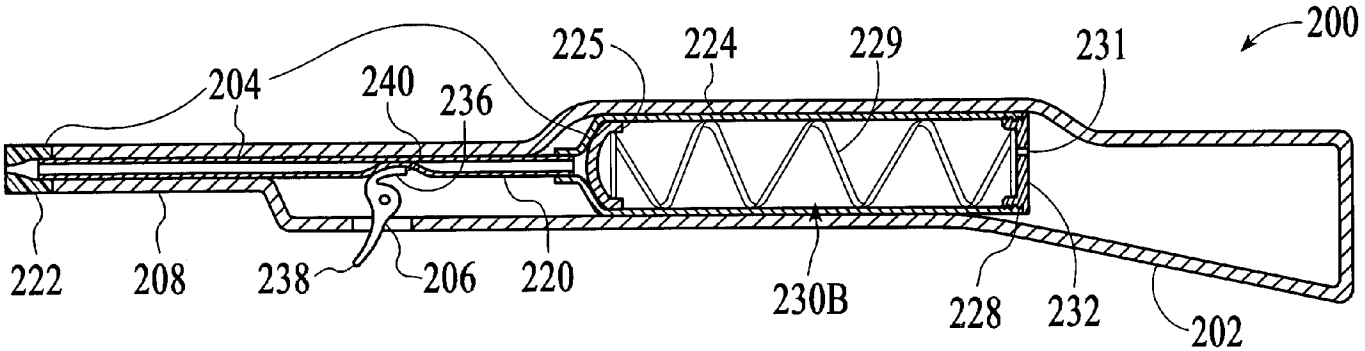
FIG. 6 is a side elevational view of a squirt gun according a second embodiment of invention, having the housing in the form of a rifle and with the vessel empty of water.

Referring next to FIGS. 6 through 1, a squirt gun according to a second embodiment of the invention is shown. This squirt gun shares the essence of the invention, in that it employs a simple means, comprised of a minimal number of components, to receive pressure and water from the supply line, to retain that pressure and water, and to release that pressure and water evenly and with effective results.

Figure 10:
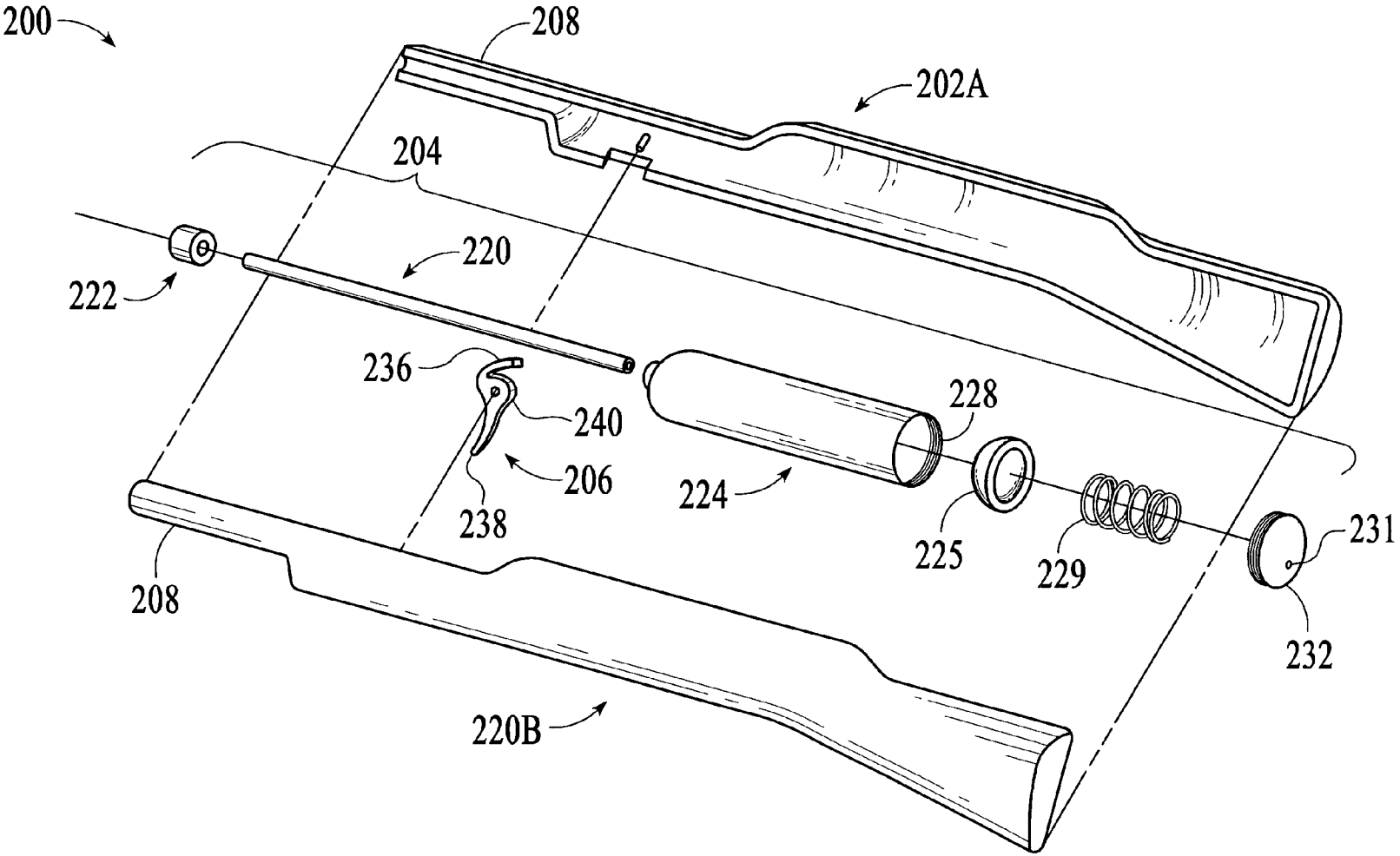
FIG. 10 is an exploded perspective view of the gun of FIG. 6.

Squirt gun 200 includes a hollow housing 202 in the shape of a rifle, a water-dispensing assembly 204, and a trigger 206. Housing 202 has a barrel portion 208. As best seen in FIG. 10, the housing is comprised of two halves, 202A and 202B, which are glued or otherwise fastened together by ordinary means common among the cited prior art (screws, integrated snaps, ultrasonic welding, etc). Water dispensing assembly 204 is mounted within housing 202, and includes a flexible tube portion 220 having a nozzle 222 at one end, and a rigid vessel 224 connected to the other end. It is anticipated that the nozzle could readily be incorporated integrally into the housing to thereby eliminate that additional component, if so desired.

In this particular embodiment, vessel 224 is a blow-molded polyethylene terephthalate bottle having a wall thickness sufficient to safely contain water at pressures substantially above the maximum anticipated from a municipal water supply. However, it is anticipated that the vessel could be incorporated into the housing 202, provided that the housing walls were sufficiently strong and the housing halves are firmly and fully sealed together.

Within vessel 224 is disposed a piston 225 which sealingly and slidably communicates with the cylindrical interior wall 226 of the vessel 224. The piston thereby separates the vessel interior chamber into a water-holding portion 230A and an energy-holding portion 230B. The side of the piston that is directed towards the water-holding portion 230A is contoured according to the contour of the vessel's nozzle end 227, for minimizing undesirably retained water in the vessel after emptying. Also, the vessel may another cross-sectional shape other than round, provided that the portion of the vessel in which the piston slides is tubular and the piston's and its seal's cross-section is arranged in a sealing relationship with that shape.

The piston 225 is biased towards the vessel's nozzle end 227 by the force of compression spring 229, which is disposed in the chamber's energy-holding portion 230B and is comprised of a resilient material so that the energy-holding portion is longitudinally compressible as the water-holding portion 230A is filled with water at pressure that is positive relative to biasing pressure that the piston 225 causes against the water-holding portion as a result of the spring's force. In the preferred embodiment, the spring is a helically wound compression spring having linear force characteristics over distance it is compressed during filling in this gun. However, it is anticipated that the spring could be replaced with any similarly compressible mechanism such a gas-inflated bladder or a foam-rubber object.

Vessel 224 has an opening 228 at the end opposite the flexible tube 220. This opening facilitates insertion of piston 225 and spring 229 into vessel 224. The spring and piston are fixedly attached together and further attached to cap 232, which closes opening 228. Vent hole 231 allows air to escape from the energy-holding portion of the chamber during filling.

Trigger 206 and the filling adaptor 300, are similar to those used in the preferred embodiment, and function in, and are used in, the same manners.

Figure 7:
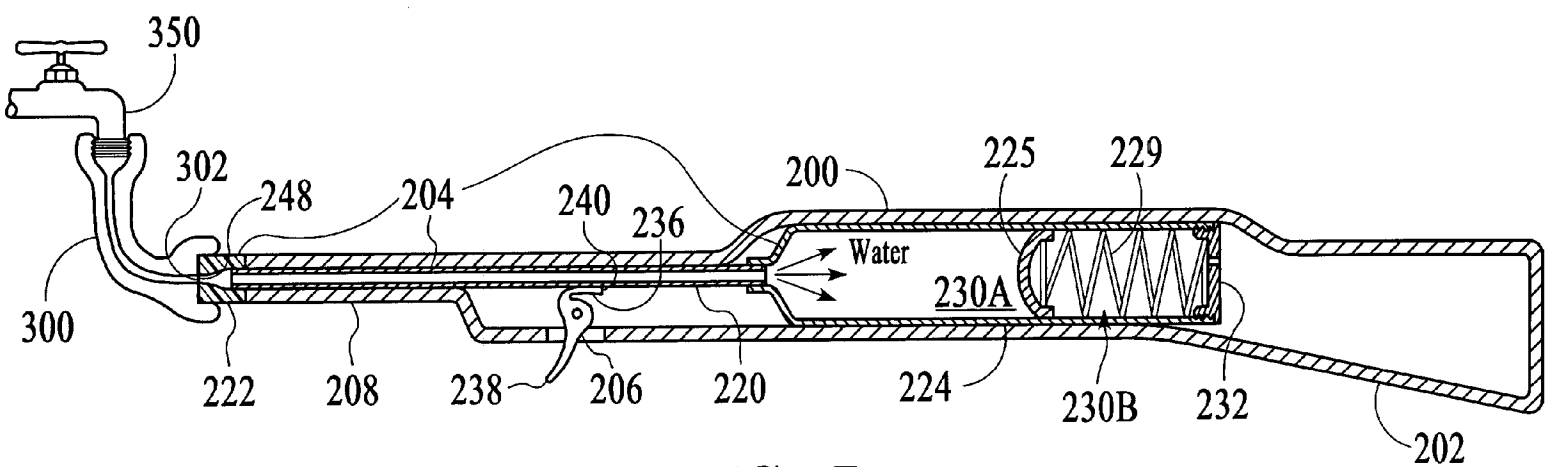
FIG. 7 is a side elevational view of the squirt gun of FIG. 6 with the nozzle connected to a water supply faucet and with water filling the vessel.
Figure 8:
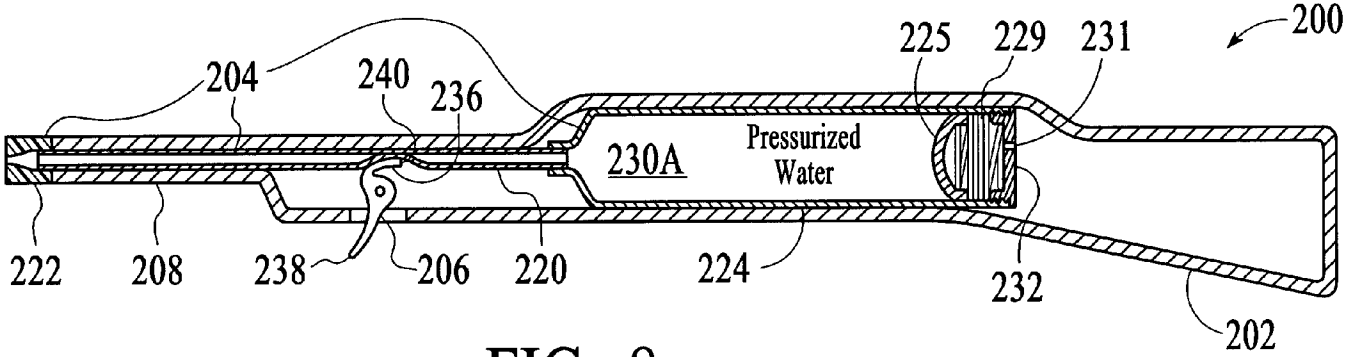
FIG. 8 is a side elevational view of the squirt gun of FIG. 6 with the vessel filled with water and the spring-loaded piston in its compressed and pressurized state.

As seen in FIG. 7, during filling, the pressure of the incoming water compresses spring 229 within energy-holding portion 230B so that water fills water-holding portion 230A as the volume the energy-holding portion is reduced and until the spring is fully compressed or the pressure exerted by the piston 225 against the water-holding portion by the force of the spring is equal to the supply pressure and a pressurized equilibrium state is reached.

Once vessel 224 is so filled, nozzle 222 is separated from adaptor 300, causing the balance of pressure across trigger 206 to reverse from its filling condition, so that the pressure within vessel 224 is now positive relative to the atmospheric pressure at nozzle 222. As a result, the resiliency of trigger arm 236 causes it to return to its natural upwardly disposed position, thereby closing tube 220 so that the pressurized water within vessel 224 cannot escape.

Figure 9:
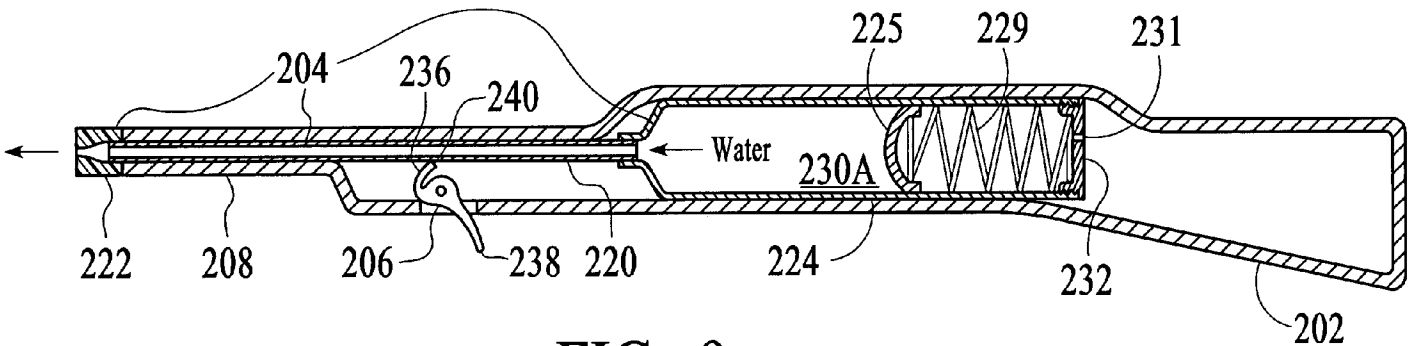
FIG. 9 is a side elevational view of the squirt gun of FIG. 6 with the trigger actuated to the "open" position and the vessel expelling water.

To squirt water from filled gun 200, trigger 206 is actuated by the user into the "open" position, as shown in FIG. 9. The water within vessel 224, being maintained at high pressure by the compression of spring 229, escapes at high velocity from vessel 224, through flexible tube 220 and nozzle 222, and squirts from the gun in a stream, similarly to the preferred embodiment.

It is found that velocity of the water stream squirting from the squirting gun 200, as well as the stream's distance, also remain relatively constant, compared to guns of the prior art, throughout the full use of gun 200, from full to empty. It is believed that this quality results from the linear force characteristics of the spring 229 over its entire operating range.

Of course, it is anticipated that a squirt gun could be similarly constructed but without the compression spring in the energy-holding portion of the chamber and instead using an extension spring within the water-holding portion of the chamber, this extension spring adapted and biased to pull the piston towards the vessel's nozzle end such that the pressure of the incoming water from the supply acted to extend the extension spring against this bias in a complimentary manner to that described above, all the while remaining within the scope of the invention.

Figure 11:
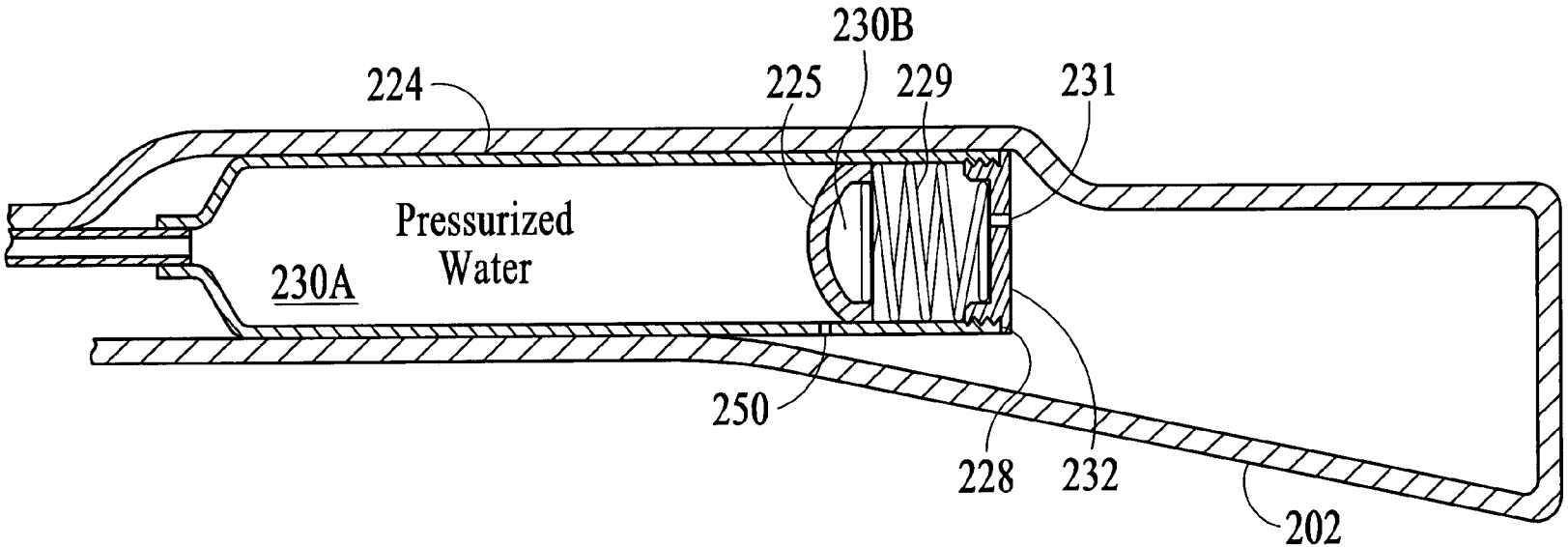
FIG. 11 is an enlarged partial view depicting an optional relief valve that may be incorporated into the vessel of the gun of FIG. 6.

Also, as depicted in FIG. 11, should a pressure-relief mechanism be desired, the vessel could be adapted with a relief orifice 250 which becomes exposed to the water-holding portion of the chamber 230A as the piston 225 moves a predetermined distance from the vessel's nozzle end. Thus, when I predetermined supply pressure is realized, trying to cause the spring 229 to compress more than a predetermined amount, the exposure of relief orifice 250 allows water from within the water-holding portion to escape, thereby preventing the pressure in the water-holding portion from becoming excessive. This provides a very inexpensive and reliable pressure-relief mechanism with no need for additional parts.

It can be seen that the squirt gun of this invention will cause a stream of liquid to be propelled at a high velocity to a great distance, while utilizing very few moving pieces and requiring no separate power supply. The squirt gun will always be capable of dispensing liquid by actuating the trigger without requiring the use to pump up pressure as in prior art squirt guns, and without requiring the use of a compressed air cartridge, electric pump, or expandable rubber water-holding bladder. It can therefore be seen that this embodiment also accomplishes all of the above-stated objectives.

A third and not shown embodiment of the invention is anticipated which combines features from the preferred and second embodiments and is most easily described as the second embodiment except that the spring and vent hole are eliminated and replaced with a gas-filled compressible bladder, similar to that of the preferred embodiment, and disposed within the energy-holding portion of the vessel. Compression of the bladder by the incoming water during filling, allows the water-holding portion of the vessel to similarly increase as the piston slides similarly within the tubular vessel, and the compressed bladder serves the same energy-holding function as had the spring, to force the piston back towards its low energy state during squirting.

The forgoing is intended to teach only several of the many possible variations of the present invention. Other embodiments and permutations are well within the scope of the invention and the forgoing is therefore not intended and should not be taken to limit the inventor's rights therein. With this in mind, the following claims present the various aspects that define the scope of the invention;

I claim:

1. In a squirt gun of the type comprising a housing having a hollow interior portion, a filling passageway between the housing's hollow interior portion and the housing's exterior, and a squirting passageway between the housing's hollow interior portion and a nozzle at the housing's exterior, and having an actuatable trigger having a first position in which communication through the squirting passageway from the housing's hollow interior portion to the nozzle is denied, and a second position in which communication between the housing's hollow interior portion to the nozzle is enabled, the improvement whereby the hollow interior portion comprises a rigid vessel with one or more openings communicating with the passageways, said vessel comprising therein a resiliently compressible element, and whereby the gun is adapted to receive water at a positive pressure through the filling passageway and into said vessel and said pressure causes said element to compress, and whereby, when the trigger is in the first position, the water received into said vessel is retained therein under pressure and, when the trigger is actuated into the second position, said retained water is forced from said vessel by the decompression of said element and through the squirting passageway and the nozzle to the housing's exterior.

2. The improvement of claim 1, in which said vessel further comprises an insertion opening for installation of said element into said vessel and means for sealing said insertion opening to seal said vessel and retain said element therein.

3. The improvement of claim 2, in which said element is attached to the interior of said vessel only at or about said insertion opening.

4. The improvement of claim 3 in which said squirting passageway is said filling passageway and said one or more openings communicating with the passageways is one opening.

5. The improvement of claim 4 in which said insertion opening is disposed substantially apart from said opening communicating with the passageways and comprises a means by which said element is so attached to the interior of said vessel thereat or thereabout.

6. The improvement of claim 5 in which said element further comprises an attachment feature, and said means by which said element is attached comprises a fastening member adapted to capture said attachment feature and retain said element at or about said insertion opening.

7. The improvement of claim 6 in which said fastening member further comprises said means for sealing said second opening.

8. The improvement of claim 3, in which said vessel further comprises pressure-release means for limiting the maximum pressure of water received therein.

9. The improvement of claim 7, in which said vessel further comprises pressure-release means for limiting the maximum pressure of water received therein.

10. The improvement of claim 1, in which said resiliently compressible element is taken from the group including a spring, a gas-filled bladder, and a resilient mass.

11. The improvement of claim 1, in which said resiliently compressible element is taken from the group including a compression spring, a compressible gas-filled bladder, and resiliently compressible mass.

12. The improvement of claim 2, in which said resiliently compressible element is taken from the group including a compression spring, a compressible gas-filled bladder, and resiliently compressible mass.

13. The improvement of claim 3, in which said resiliently compressible element is taken from the group including a compression spring, a compressible gas-filled bladder, and resiliently compressible mass.

14. The improvement of claim 4, in which said resiliently compressible element is taken from the group including a compression spring, a compressible gas-filled bladder, and resiliently compressible mass.

15. The improvement of claim 5, in which said resiliently compressible element is taken from the group including a compression spring, a compressible gas-filled bladder, and resiliently compressible mass.

16. The improvement of claim 6, in which said resiliently compressible element is taken from the group including a compression spring, a compressible gas-filled bladder, and resiliently compressible mass.

17. The improvement of claim 7, in which said resiliently compressible element is taken from the group including a compression spring, a compressible gas-filled bladder, and resiliently compressible mass.

18. The improvement of claim 8, in which said resiliently compressible element is taken from the group including a compression spring, a compressible gas-filled bladder, and resiliently compressible mass.

19. The improvement of claim 9, in which said resiliently compressible element is taken from the group including a compression spring, a compressible gas-filled bladder, and resiliently compressible mass.

* * * * *